US012569737B2

(12) United States Patent
Dickerson

(10) Patent No.: US 12,569,737 B2
(45) Date of Patent: Mar. 10, 2026

(54) REBOUNDER SYSTEMS AND METHODS

(71) Applicant: Ryan L. Dickerson, Mooresville, NC (US)

(72) Inventor: Ryan L. Dickerson, Mooresville, NC (US)

( * ) Notice: Subject to any disclaimer, the term of this patent is extended or adjusted under 35 U.S.C. 154(b) by 608 days.

(21) Appl. No.: 17/930,726

(22) Filed: Sep. 9, 2022

(65) Prior Publication Data

US 2023/0181983 A1 Jun. 15, 2023

Related U.S. Application Data

(60) Provisional application No. 63/250,612, filed on Sep. 30, 2021.

(51) Int. Cl.
*A63B 69/00* (2006.01)
*A63B 63/00* (2006.01)

(52) U.S. Cl.
CPC ..... *A63B 63/004* (2013.01); *A63B 2063/001* (2013.01); *A63B 2210/50* (2013.01)

(58) Field of Classification Search
CPC ..... A63B 2063/001; A63B 63/004
USPC ..... 473/435
See application file for complete search history.

(56) References Cited

U.S. PATENT DOCUMENTS 5,005,837 A * 4/1991 Urra Martinez ... A63B 69/3652 473/279
5,833,234 A * 11/1998 Vavala ..... A63B 69/0097 473/434
6,142,892 A * 11/2000 Dennis ..... A63B 63/004 473/477
6,656,065 B2 * 12/2003 Nye ..... A63B 71/023 473/481
6,846,253 B1 * 1/2005 Szwalek ..... A63B 63/004 473/422
6,935,971 B2 * 8/2005 Piras ..... A63B 69/002 473/422
8,177,651 B2 * 5/2012 Curry ..... A63B 65/06 473/181
10,166,453 B1 * 1/2019 Dickerson ..... A63B 63/00 473/434
11,819,747 B2 * 11/2023 Fedon ..... A63B 71/023 473/478
2011/0059815 A1 * 3/2011 Jones ..... A63B 69/0097 473/435

* cited by examiner

*Primary Examiner* — Mitra Aryanpour
(74) *Attorney, Agent, or Firm* — The Law Office of Mario T Milano LLC

(57) ABSTRACT

Elastic athletic systems, including ball rebounder systems, and methods for assembly and use. A ball rebounder system includes a frame having a target portion and a support portion, a net, and a net attachment tool. The net attachment tool increases leverage and may be used to tightly secure the net to the target portion, and an angle between the target portion and the support portion may be adjusted with a foot pedal such that the net rebounds a ball at a higher or lower trajectory depending on the angle. A lower crossbar of the frame may include a plurality of net hooks that secure the net in a forward position such that the ball does not contact the lower crossbar during use. The ball rebounder system may be used to rebound the ball to an athlete as part of training.

20 Claims, 17 Drawing Sheets

7

REBOUNDER SYSTEMS AND METHODS

CROSS-REFERENCE TO RELATED APPLICATIONS

This application claims the benefit of U.S. Provisional Application No. 63/250,612, filed Sep. 30, 2021.

FIELD

The disclosure relates to athletic training equipment and methods of assembly and use. A ball rebounder system includes a frame having a target portion and a support portion, a net, and a net attachment tool. The net attachment tool increases leverage for manual securement of the net to the target portion. An angle between the target portion and the support portion may be adjusted such that the net rebounds a ball at a higher or lower trajectory depending on the angle. A support crossbar of the frame includes a plurality of net hooks that secure the net in a forward position such that the ball does not contact the support crossbar during use. The ball rebounder system may be used to rebound the ball to an athlete as part of training.

BACKGROUND

Many athletes use elastic training equipment, such as ball rebounders, for practice and recreation. Soccer players use ball rebounders by kicking a ball at the ball rebounder, and the ball rebounder bounces the ball back to the player for another kick. Other athletes, such as lacrosse players, tennis players, golfers, baseball players, handball players, and others, also may utilize ball rebounders as part of training. The elasticity of the ball rebounders is typically achieved with an elastic or flexible component, such as a net or mesh. Other athletes, such as gymnasts, use trampolines for training, and a similar principle operates the trampoline: the gymnast jumps on the trampoline, and the elastic structure of the trampoline mesh bounces the gymnast back upward for another jump.

A problem with existing elastic training equipment is that the net or mesh is difficult to apply by hand. This is typically due to increased tension in the net or mesh as the net or mesh is stretched to fit around a structure, such as a frame of a ball rebounder or a frame of a trampoline. If the net or mesh is made to be looser, such that the elasticity of the net or mesh is less and there is less tension when stretched, the net or mesh may be more easily applied to the equipment, however, the equipment may lose its effectiveness or appeal for training due to not effectively bouncing the ball or the athlete during use.

In addition, a shortcoming with existing ball rebounders is that these devices are typically only able to bounce the ball back at a fixed trajectory based on a fixed angle between a target portion and a frame portion of the equipment. The fixed angle is not adjustable, and the trajectory cannot change or be customized for a particular application. This equipment has limited use and cannot be used for different training activities typically performed for athletic practice, such as passing, shooting, dribbling, throwing, catching, and the like. As a result, existing ball rebounders have limited usefulness for many athletes who need to be able to train for a variety of different maneuvers and mechanics for practice or competition.

A further shortcoming of existing ball rebounders is that when balls contact lower portions of the rebounders, they often contact support crossbars, which cause the ball to rebound at an unexpected trajectory. This can occur directly with direct contact between the ball and the support crossbar, or can occur indirectly, such that the ball contacts the net and then contacts the support crossbar through the net. In either case, balls that contact these rebounders lowly often act unpredictable and this can hinder training exercises and other uses.

Accordingly, there is a need for improved elastic training equipment, including improved ball rebounders that are more easily assembled and that are more configurable for a variety of different athletic activities. The present invention addresses this unmet need.

SUMMARY

In one aspect, the disclosure provides a rebounder system, comprising a net and a frame having a target portion and a support portion. The net is securable to the target portion to form a goal, and an angle between the target portion and the support portion is adjustable, such that the goal rebounds a ball at a trajectory based on the angle. In implementations, the angle may be adjustable by an operation of a foot pedal and a pivot movement of the target portion relative to the support portion about a pivot point. A plurality of net hooks positioned along forward portions of a support crossbar hold and secure the net in a forward position relative to the support crossbar, such that a ball, e.g., a soccer ball, bounces off the net and does not bounce off the support crossbar.

In another aspect, the disclosure provides a net attachment tool configured to secure the net to the target portion to form the goal. In implementations, the net attachment tool increases leverage and includes a handle portion and a hook portion, and the hook portion is configured to hook a portion of the net.

In another aspect, the disclosure provides a rebounder system, comprising a net having an elastic cord attached along a portion of a perimeter thereof, a frame having a target portion, such that the net is securable to the target portion to form a goal, and a net attachment tool configured to secure the net to the target portion via the elastic cord to form the goal. The goal rebounds an object, including but not limited to a ball (e.g., a soccer ball, a baseball, a softball, a volleyball, a basketball, a lacrosse ball, etc.) or an athlete (e.g., a gymnast) that impacts the goal. The rebounder system may be a ball rebounder, a trampoline, or both, or may be a different rebounder system, without departing from the scope of the disclosure.

In yet another aspect, the disclosure provides a method for assembling a rebounder system, the method comprising attaching a plurality of bars with a plurality of fasteners to form a frame having a target portion and a support portion, such that an angle between the target portion and the support portion is adjustable, and attaching a net to the target portion to form a goal. The net may be attached to the target portion by use of the net attachment tool. The angle may be adjusted with a foot pedal, and the goal may be used to rebound a ball at a trajectory based on the angle. When the ball rebounder system needs to be stored or transported, the angle can be adjusted again to make the system more compact.

Various embodiments of the rebounder system may be configured for a particular sport or activity, and these include variations in dimensions as well as design features. For example, while some ball rebounder systems may have an elastic cord at all four sides of a rectangular target portion, a soccer rebounder system may have the elastic cord at a left side, a right side, and a top side, and the bottom side may be devoid of the elastic cord so that the net extends closer to the ground and rolling soccer balls can be effectively rebounded by the system. Other variations, such as variations in height, width, shape, and size, are envisioned.

Another object of the present invention is to provide ball rebounder systems, and kits containing ball rebounder systems, that may be manufactured using suitable materials and scaled according to need.

Other objects, features and advantages of the present invention will become apparent from the following detailed description taken in conjunction with the accompanying drawings.

BRIEF DESCRIPTION OF THE DRAWINGS

Although the characteristic features of the invention will be particularly pointed out in the claims, example implementations of the invention and manners in which they may be made and used may be better understood after a review of the following description, taken in connection with the accompanying drawings, wherein like numeral annotations are provided throughout.

DETAILED DESCRIPTION

Figure 1:
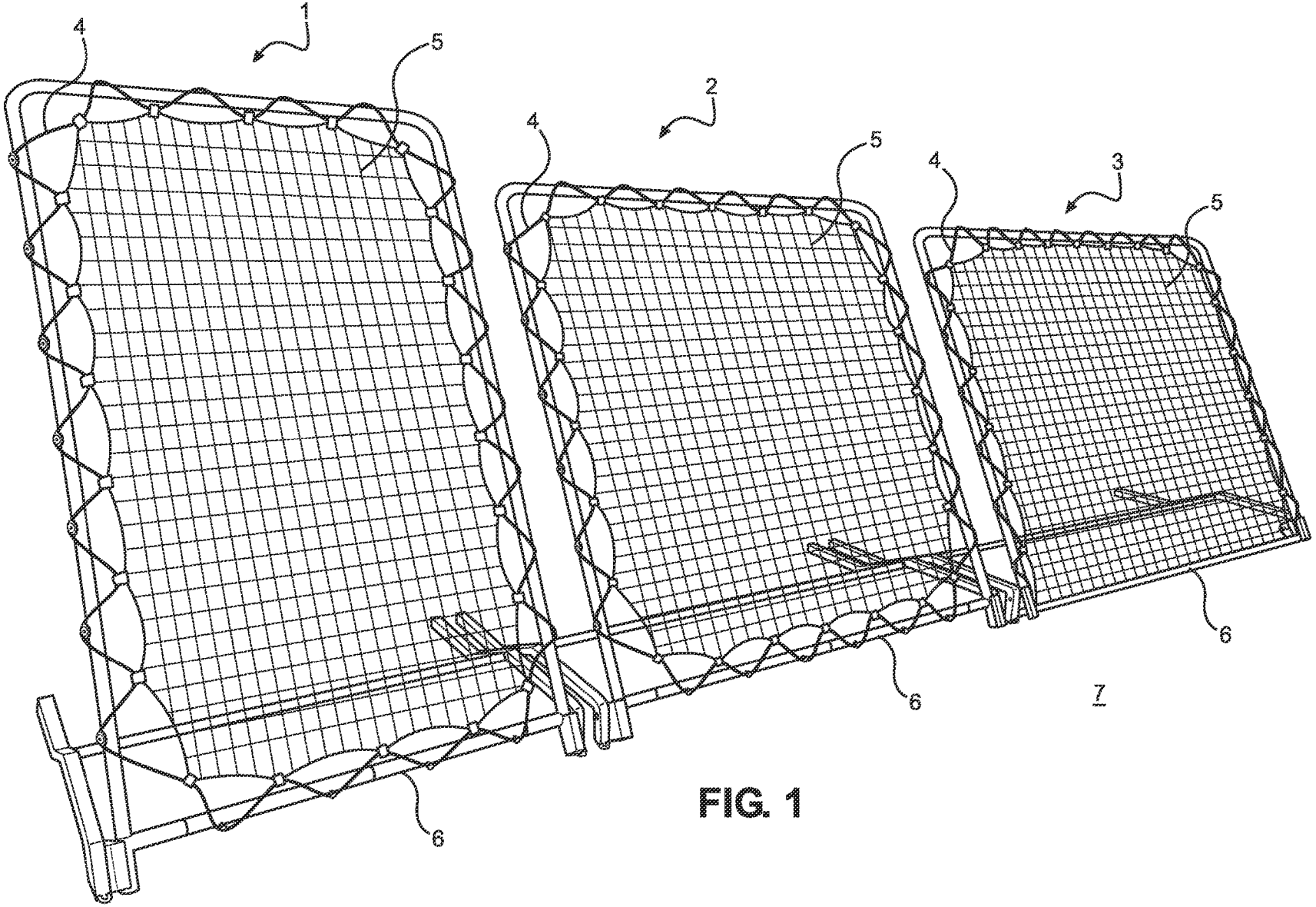
FIG. 1 shows a perspective view of three example ball rebounder systems.

Reference is made herein to the attached drawings. Like reference numerals may be used in the drawings to indicate like or similar elements of the description. The figures are intended for representative purposes, are not drawn to scale, and should not be considered limiting.

Unless otherwise defined herein, terms and phrases used in connection with the present disclosure shall have the meanings that are commonly understood by those of ordinary skill in the art.

Where a reference is made to a singular noun, whether with or without use of an indefinite or definite article (e.g., "a", "an", or "the"), this includes a plural of that noun unless something else is specifically stated. Furthermore, the terms first, second, third, and the like in the description and in the claims, are used for distinguishing between elements and not necessarily for describing a sequential or chronological order. It is to be understood that the terms so used are interchangeable under appropriate circumstances and that the implementations of the disclosure described herein are capable of operation in other sequences than described or illustrated herein.

As used herein, the term "about" refers to the usual error range for the respective value readily known to the skilled person in this technical field. Reference to "about" a value or parameter herein includes and describes implementations and embodiments that are directed to that value or parameter per se.

As used herein, terms that may indicate an ability of an element to have a property or characteristic as part of a state of the element include states of the element in which it has the property or characteristic (e.g., is attachable and is attached) as well as states of the element in which it does not have the property or characteristic (e.g., is attachable but is not attached), unless something else is specifically stated. If an element is described as having a property or characteristic (e.g., is attached), this includes elements that may conditionally have the property or characteristic (e.g., may be conditionally attached) as well as elements that may unconditionally have the property or characteristic (e.g., may be unconditionally attached), unless something else is specifically stated.

I. Rebounder Systems

In general, the disclosure provides improved rebounder systems, particularly ball rebounder systems, that enable individuals to easily assemble, configure for use, use, configure for storage and transport, store and transport, and disassemble the systems. The rebounder systems utilize frames having a target portion and a support portion with an adjustable angle therebetween, such that the frame can be configured to rebound an object at a low angle, at an intermediate angle, and at a high angle during different uses and to enable athletes to perform or practice different athletic techniques. The systems may utilize nets that are reversibly attachable to the frames via use of net attachment tools, which are also provided and in at least some embodiments constitute part of the system and/or a kit.

a. Nets and Frames

Referring now to FIG. 1, there is shown a perspective view of three example ball rebounder systems. In the shown example embodiment, there is a lacrosse rebounder system 1, a baseball rebounder system 2, and a soccer rebounder system 3. The lacrosse rebounder system 1 is slightly taller and narrower than the baseball rebounder system 2 and the soccer rebounder system 3 due to the typical athletic movements involved with throwing lacrosse balls. The baseball rebounder system 2 is slightly wider and may be more square-shaped to enable a pitcher, for example, to throw a baseball toward the center of the net and have the baseball rebounded therefrom. The systems (1, 2, 3) each include an elastic cord 4 that is attached to a net 5 and that is also attached to the frame. In the case of the lacrosse system 1 and the baseball system 2, the net 5 is attached to all portions of the target portion of the frame via the elastic cord 4, however, in the case of the soccer system 3, the net 5 is attached to the left portion, the top portion, and the right portion of the frame via the elastic cord 4, but is attached to the lower crossbar 6 of the frame via direct attachment. Since soccer often involves rolling soccer balls on an adjacent ground 7, a rolling soccer ball contacts the net, which is lower to the ground, more reliably to effectively rebound the soccer ball in these instances. In the following description the soccer system 3 is described as an example, however, the principles of assembly, configuration, use, and disassembly may generally apply to other embodiments as would be understood by the person having ordinary skill in the art.

Figure 2A:
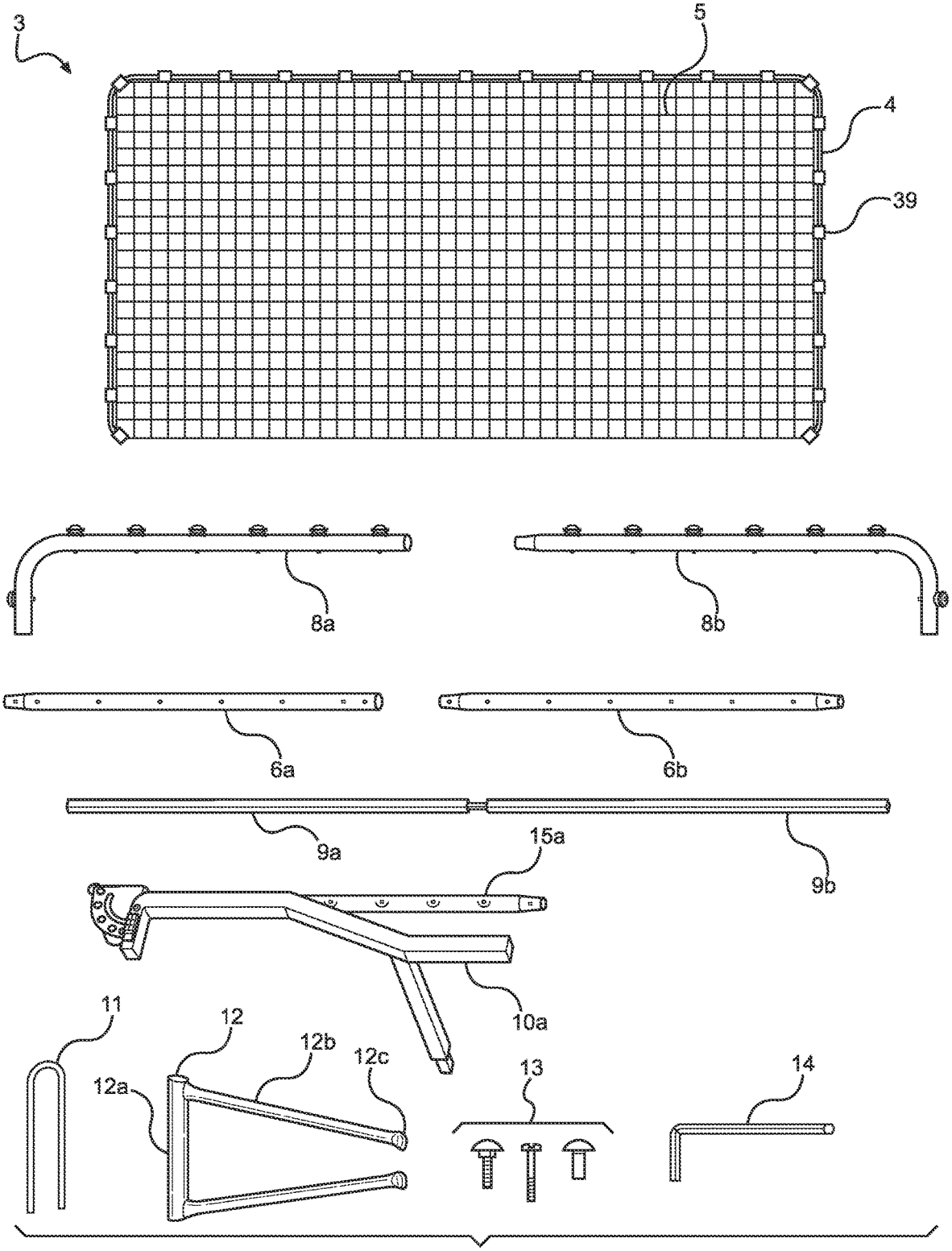
FIG. 2A shows a plurality of components of an example soccer rebounder system.
Figure 2B:
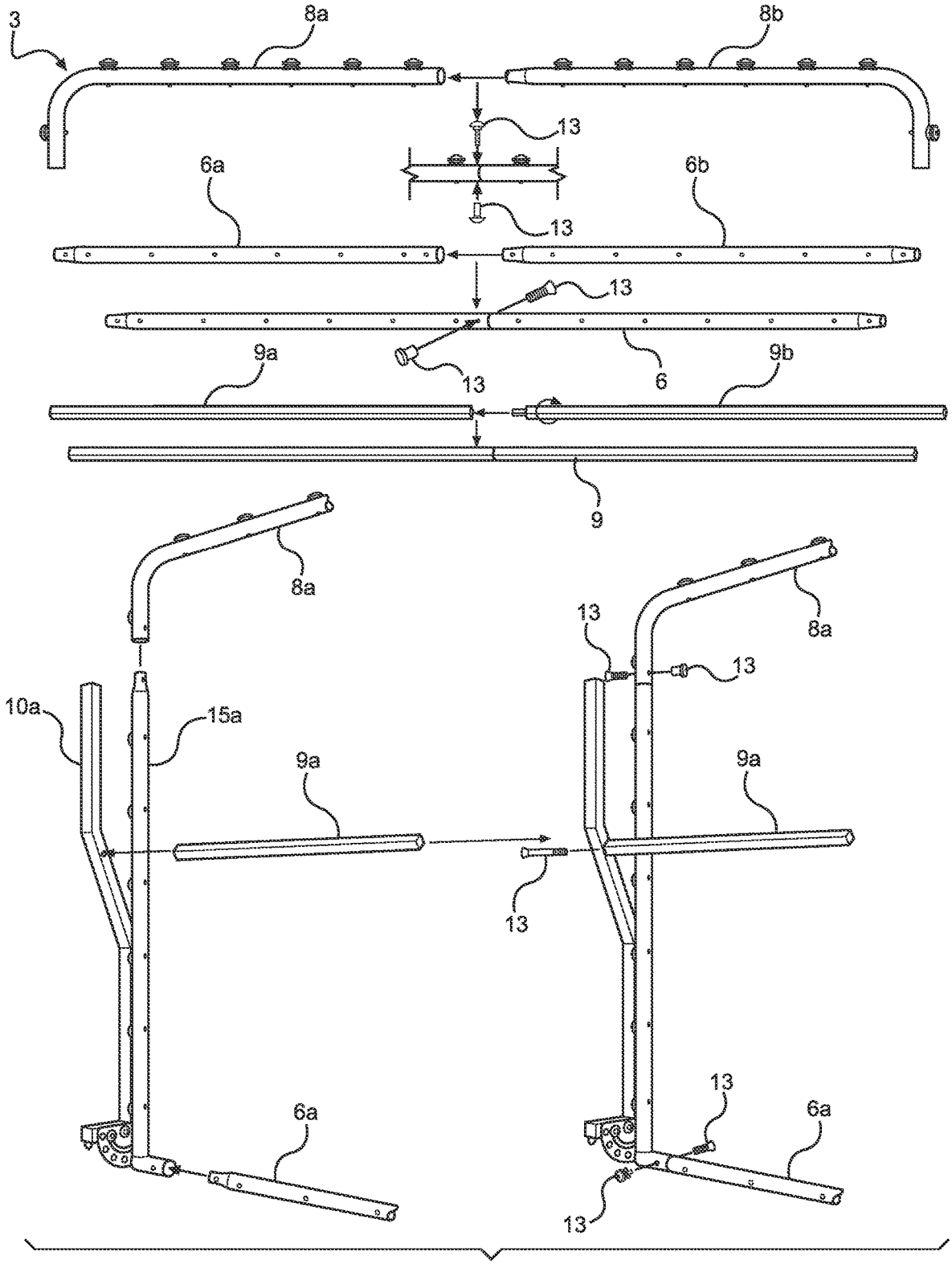
FIG. 2B shows a plurality of steps of assembly of components of the example soccer rebounder system.

Referring now to FIG. 2A, there is shown a plurality of components of an example soccer rebounder system, and at FIG. 2B, there is shown a plurality of steps of assembly of components of the example soccer rebounder system. At FIG. 3A, there is shown a perspective view of the system with the frame in an assembled state.

In embodiments, the frame of the system 3 may be metal and be comprised of a plurality of bars (6*a*, 6*b*, 8*a*, 8*b*, 9*a*, 9*b*, 10*a*, 10*b*, 15*a*, 15*b*) that are attachable together with a plurality of fasteners 13 and tools 14. In implementations, the ball rebounder system 3 includes a plurality of stakes 11 configured to secure the frame to a ground thereunder. The target portion may be comprised of a plurality of target portion bars (6*a*, 6*b*, 8*a*, 8*b*, 15*a*, 15*b*) and the support portion may be comprised of a plurality of support portion bars (9*a*, 9*b*, 10*a*, 10*b*).

A net 5 is attached to an elastic cord 4 (e.g., a bungie cord) about a perimeter or a portion of the perimeter of the net 5, via a plurality of attachments 39. The attachments 39 may be knots, sleeves, clips (e.g., plastic clips), or another attachment type. The elastic cord 4 may be stretched to attach the net 5 to a plurality of elastic cord attachments 17 positioned on an outer perimeter of the target portion, for example, using a net attachment tool 12 that includes a handle portion 12*a* affixed to a hook portion 12*c* via a middle portion 12*b*. Attachments 17 may be plastic and may include grooves thereon configured to receive the elastic cord 4 therein. In the shown implementation of the soccer rebounder system 3, a lower portion of the net 5 does not include the elastic cord 4 thereon, and only left, right, and top portions of the net 5 include the elastic cord 4 thereon such that rolling soccer balls more reliably contact the net 5 during use. However, in other embodiments (e.g., lacrosse rebounder systems, baseball rebounder systems, etc.) the lower portion of the net 5 may also include the elastic cord 4 thereon. Further, a plurality of net hooks (see 16 of FIG. 3A) holds the net in a forward and downward position relative to the support crossbar 9, such that the soccer ball does not impact the support crossbar 9 during use and instead impacts the net 5 for the rebound.

An upper crossbar 8 (comprised of 8*a* and 8*b*), a lower crossbar 6 (comprised of 6*a* and 6*b*), and a support crossbar 9 (comprised of 9*a* and 9*b*) may be assembled by attaching the respective bars as shown at FIGS. 2A and 2B. The left vertical member 15*a* and the right vertical member 15*b* may be attached to the upper crossbar 8 and the lower crossbar 6, and the support crossbar 9 may be attached to the left support member 10*a* and the right support member 10*b*.

In embodiments, the target portion is about rectangular and includes the left vertical member 15*a* attached to the right vertical member 15*b* by the upper crossbar 8 and the lower crossbar 6. The support portion may include the left support member 10*a* affixed to the right support member 10*b* by the support crossbar 9. The left support member 10*a* and the right support member 10*b* may extend rearward and downward from the target portion. The frame, once assembled, may be secured by affixing stakes 11 thereon to secure the frame to a surface or ground thereunder, such as a soccer field. Angle adjustment wheels (e.g., 18*a*, 18*b*) may be operated to adjust the angle between the target portion and the support portion to adjust the rebound trajectory implemented by the goal after attaching the net 5 to the target portion and impacting the ball against the goal during use.

Figure 3A:
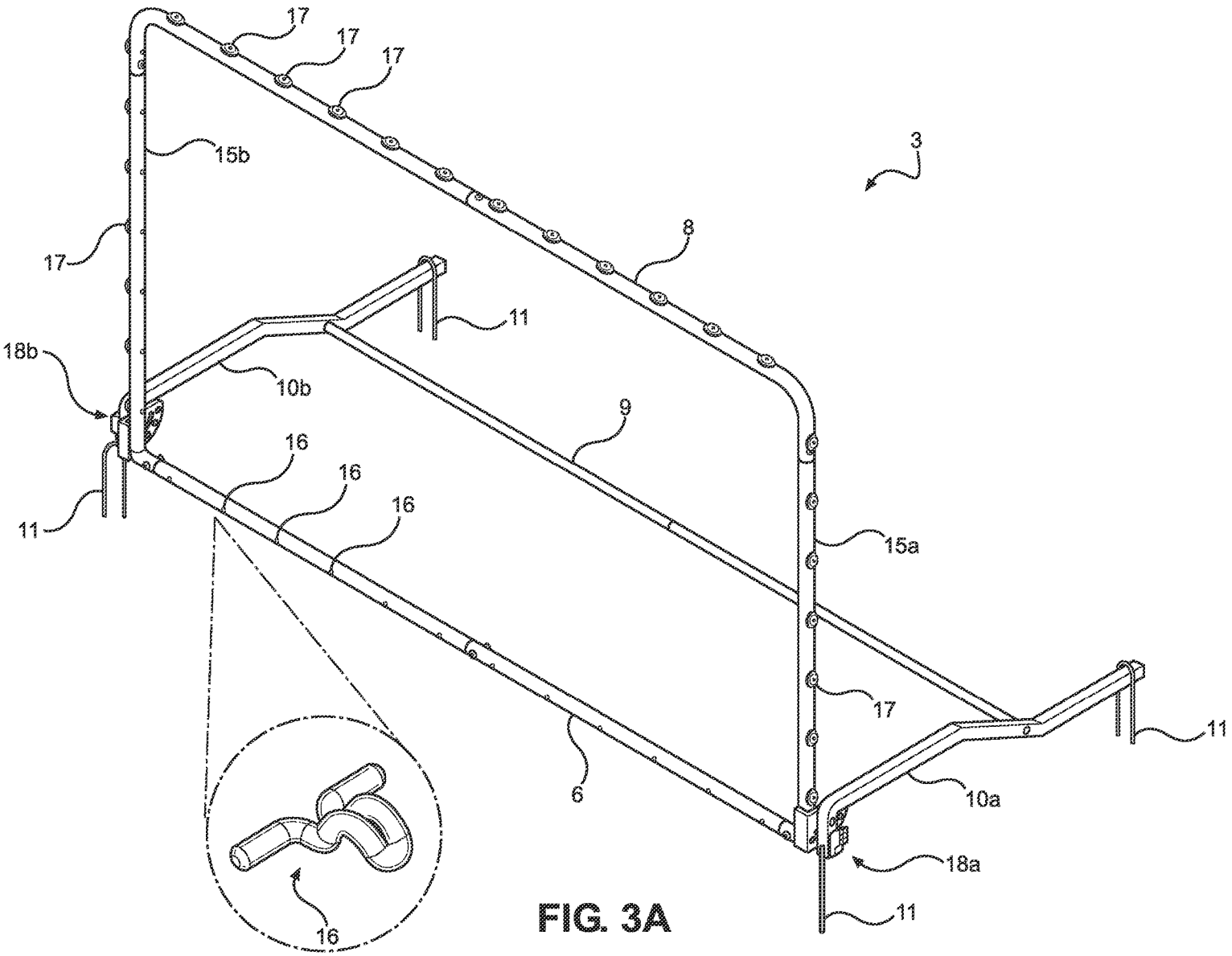
FIG. 3A shows a perspective view of the frame of the example soccer rebounder system, with an inset showing an example net hook.
Figure 3B:
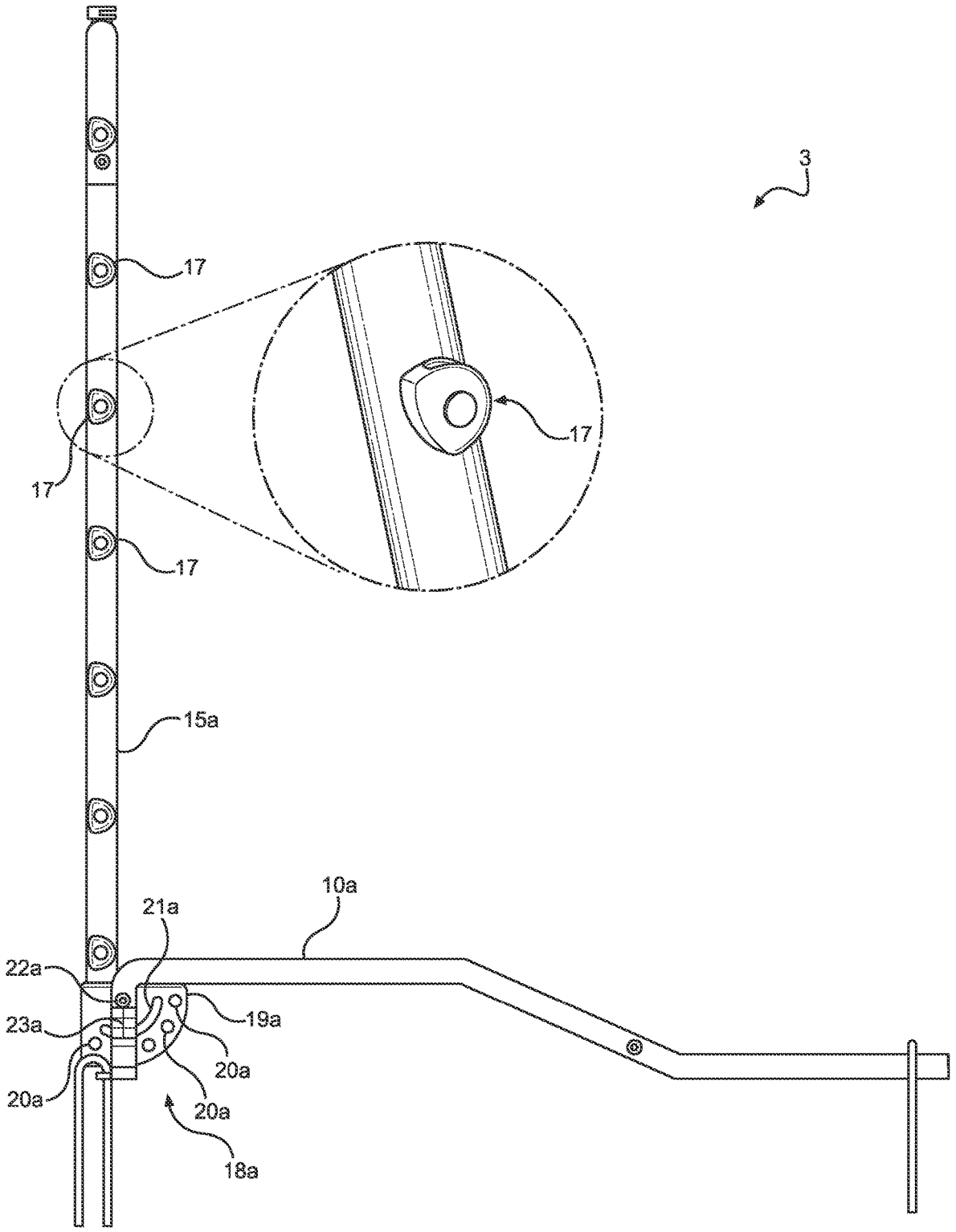
FIG. 3B shows a left side view of the frame of the example soccer rebounder system, with an inset showing an example elastic cord hook.

Referring now to FIG. 3A, there is shown a perspective view of the frame of the example soccer rebounder system, with an inset showing an example net hook, and at FIG. 3B, there is shown a left side view of the frame of the example soccer rebounder system, with an inset showing an example elastic cord hook. In the case of the example lacrosse system and the example baseball system, the elastic cord attachments 17 extend all around the target portion of the frame, however, in the case of the example soccer system 3 as shown, the lower crossbar 6 includes a plurality of net hooks 16 thereon in place of the elastic cord attachments 17. The net hooks 16 may be comprised of a unitary structure that resembles a hook of a basketball hoop. The net hooks 16 may be positioned regularly along the lower crossbar 6 for direct attachment of the net thereto, without use of the elastic cord.

Figure 5A:
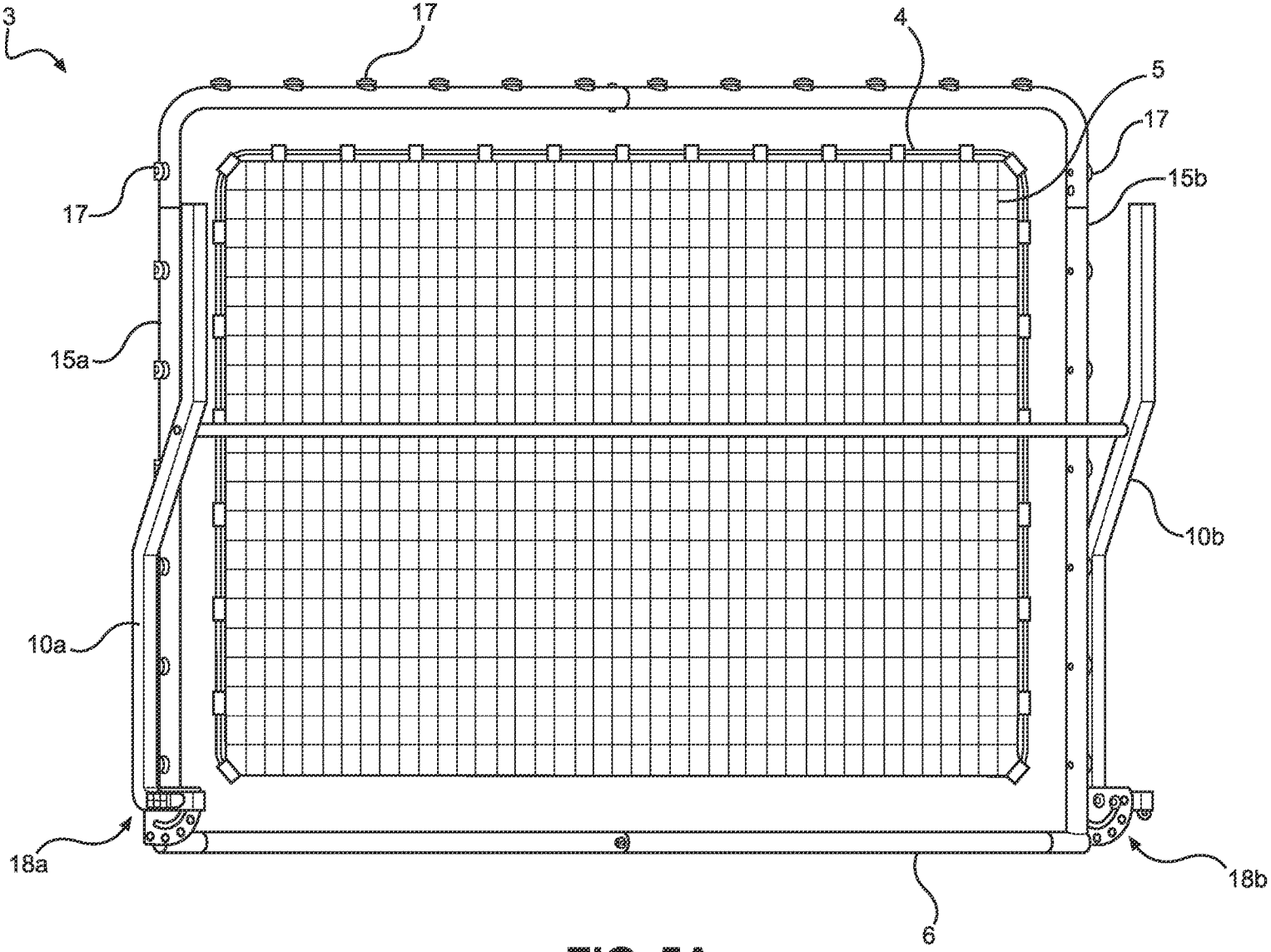
FIG. 5A shows a perspective view of the example soccer rebounder system with the frame angle minimized.
Figure 5B:
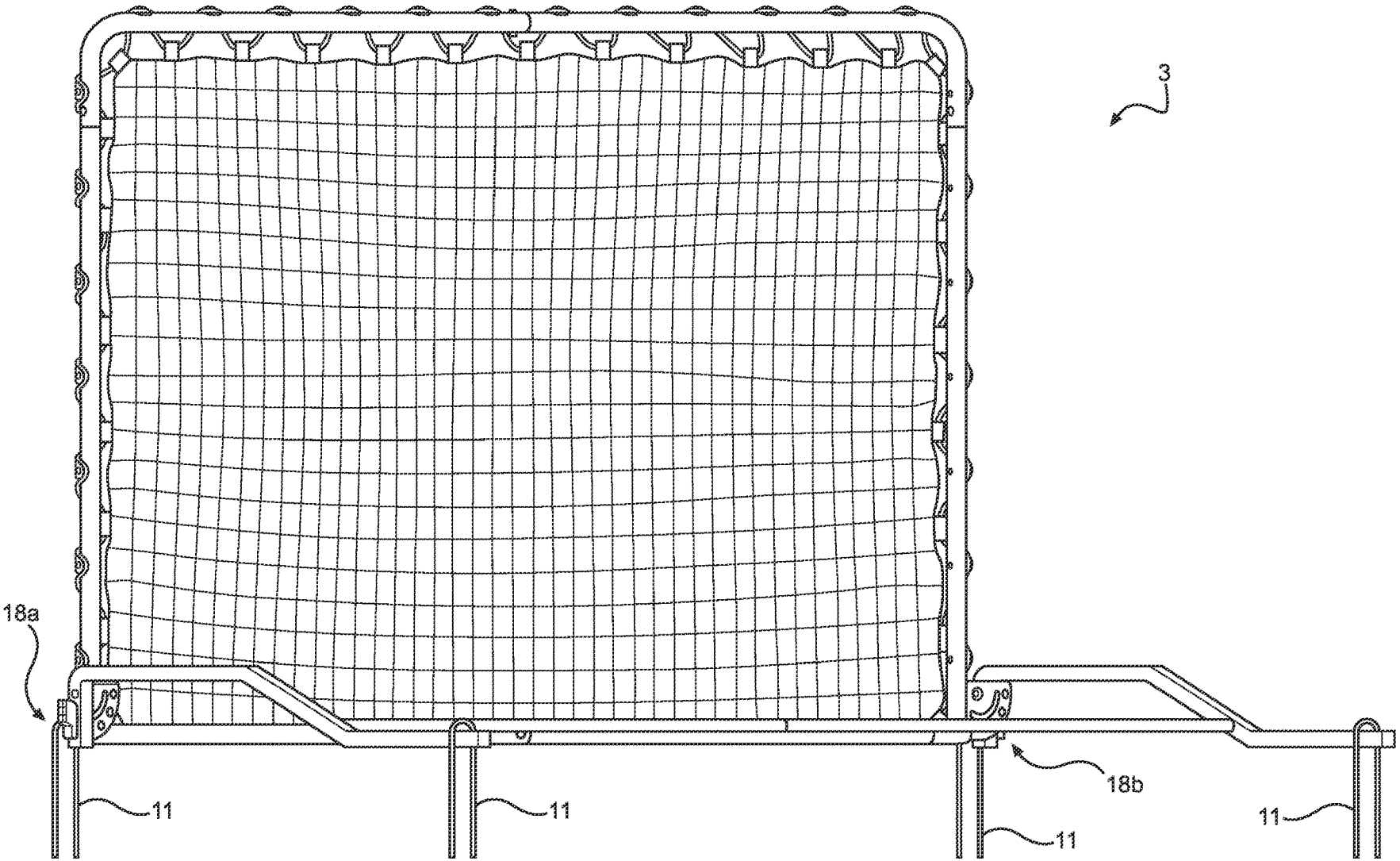
FIG. 5B shows a perspective view of the example soccer rebounder system with the frame angle expanded.
Figure 5C:
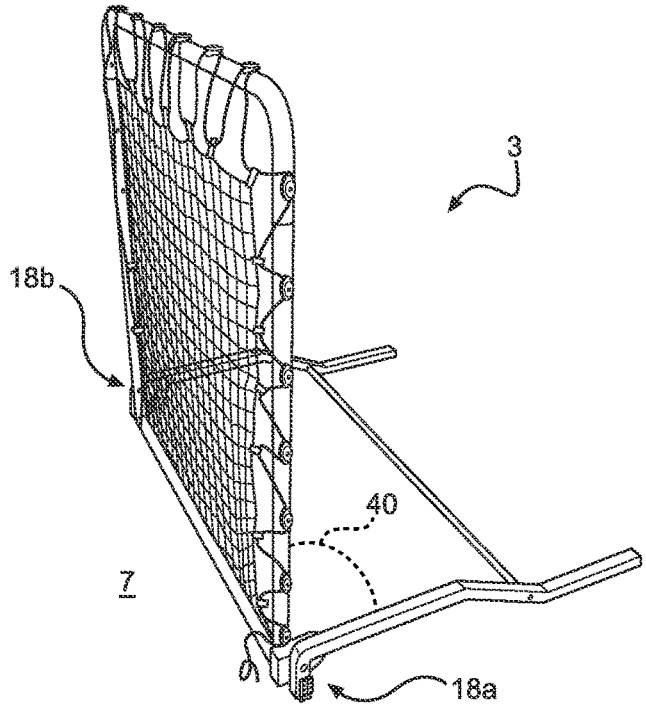
FIG. 5C shows a perspective view of the example soccer rebounder system with the frame angle at an intermediate position.
Figure 5D:
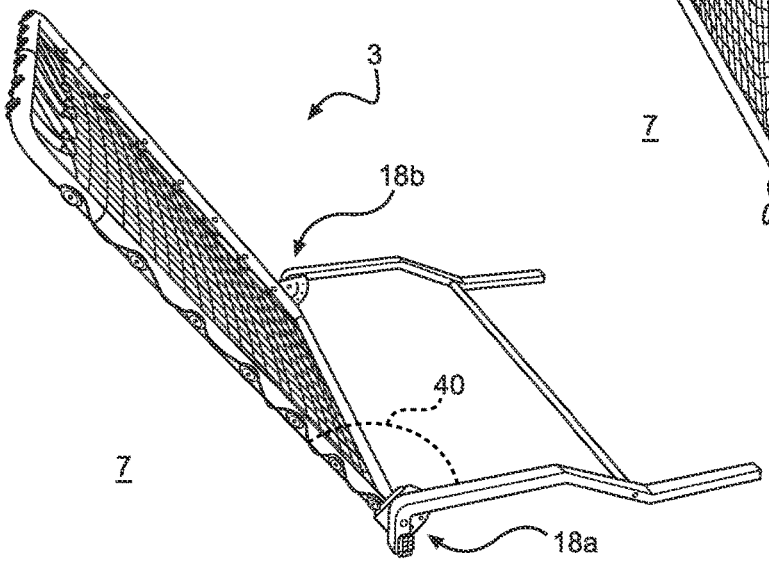
FIG. 5D shows a perspective view of the example soccer rebounder system with the frame angle at an increased position.
Figure 5E:
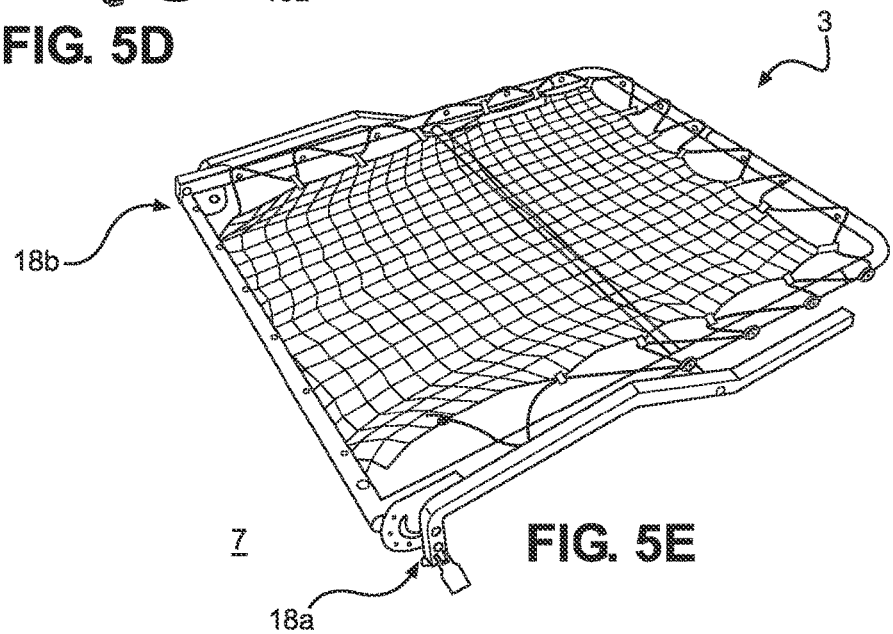
FIG. 5E shows a perspective view of the example soccer rebounder system with the frame angle at a decreased position.

Referring now to FIGS. 5A, 5B, 5C, 5D, and 5E, there are shown perspective views of the example soccer rebounder system with the frame angle minimized (FIG. 5A), expanded (FIG. 5B), at an intermediate position (FIG. 5C), at an increased position (FIG. 5D), and at a decreased position (FIG. 5E). A ball rebounder system 3 comprises a net and a frame having a target portion and a support portion. The net is securable to the target portion to form a goal, and an angle 40 between the target portion and the support portion is adjustable, such that the goal rebounds a ball at a trajectory based on the angle 40 (see FIGS. 7A-7E). In this manner, the ball rebounder system 1 may be configured for a variety of different angles 40 and rebound trajectories, and also may be configured to be compact for storage or transport.

b. Angle Adjustment Wheels

Figure 4A:
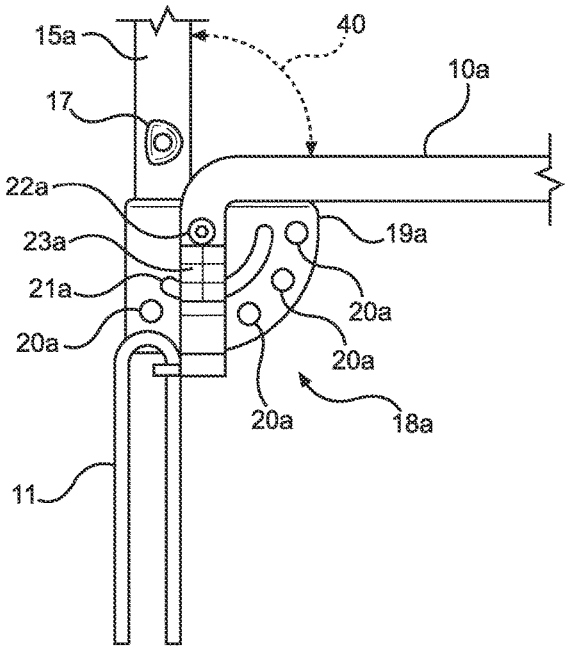
FIG. 4A shows a left side view of an angle adjustment wheel of the frame of the example soccer rebounder system.
Figure 4B:
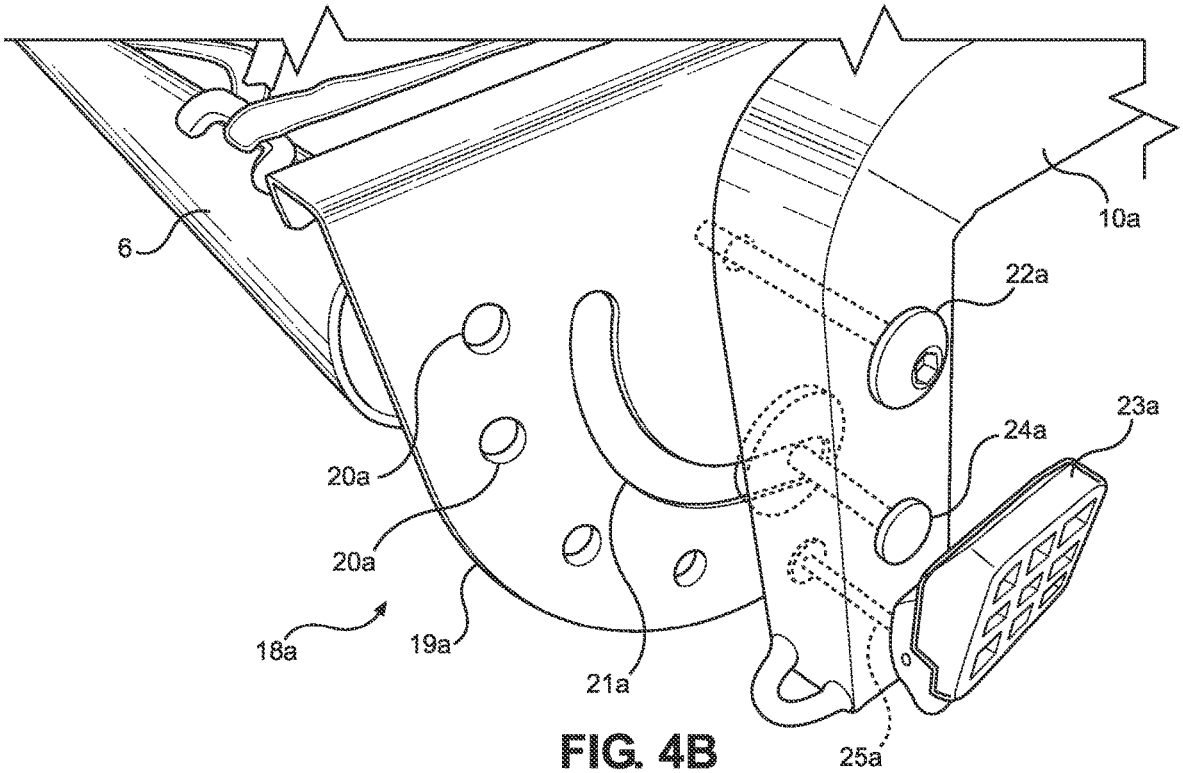
FIG. 4B shows a perspective view of the angle adjustment wheel of the frame of the example soccer rebounder system.
Figure 4C:
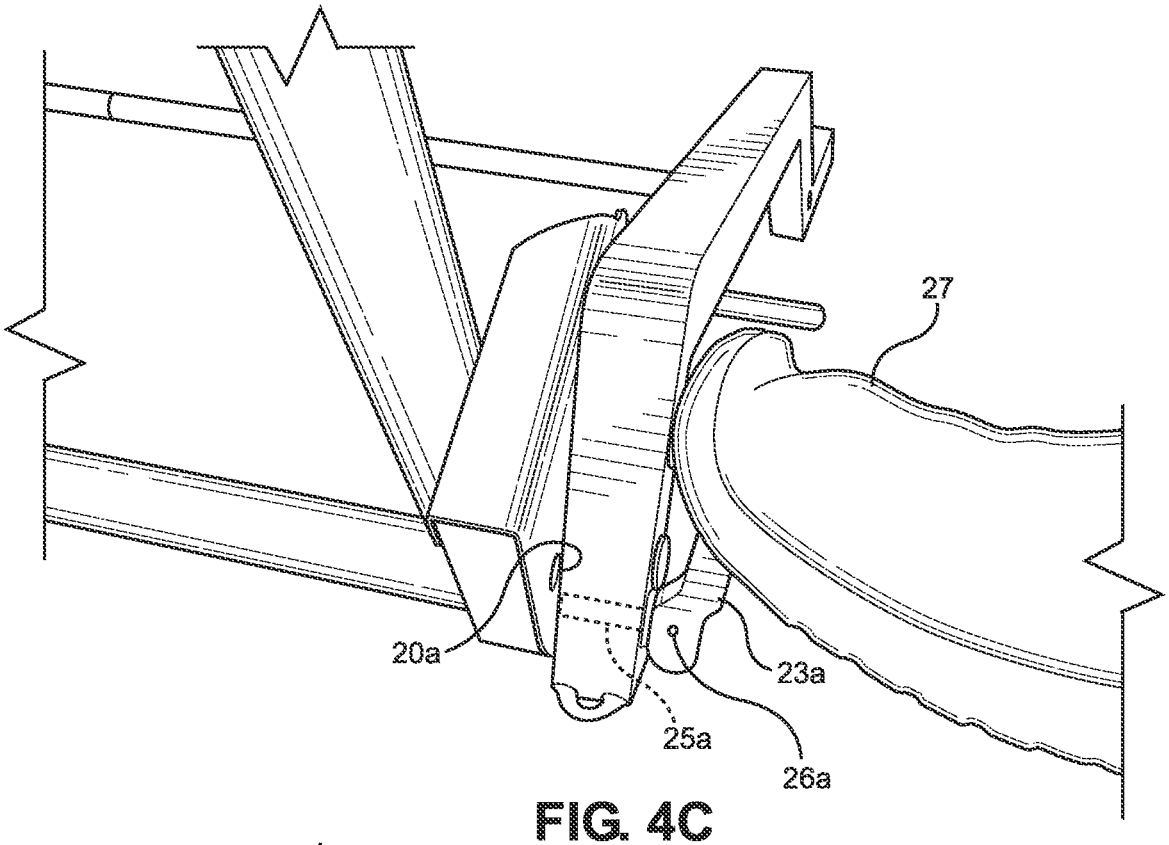
FIG. 4C shows a perspective view of use of the angle adjustment wheel to release the support portion of the frame from the target portion of the frame for adjustment of the angle of the frame before release.
Figure 4D:
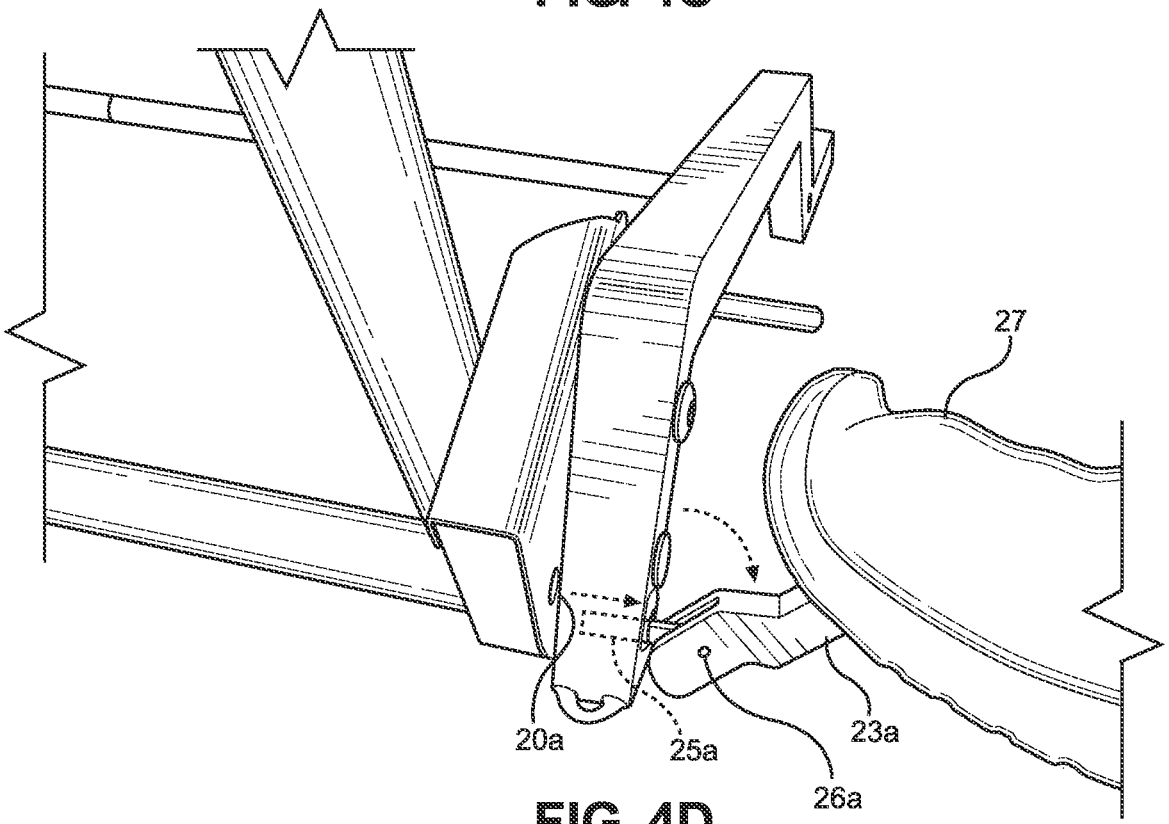
FIG. 4D shows a perspective view of use of the angle adjustment wheel to release the support portion of the frame from the target portion of the frame for adjustment of the angle of the frame after release.

Referring now to FIGS. 4A, 4B, 4C, and 4D, there are shown a left side view of an angle adjustment wheel of the frame of the example soccer rebounder system (FIG. 4A), a perspective view of the angle adjustment wheel of the frame of the example soccer rebounder system (FIG. 4B), a perspective view of use of the angle adjustment wheel to release the support portion of the frame from the target portion of the frame for adjustment of the angle of the frame before release (FIG. 4C), and a perspective view of use of the angle adjustment wheel to release the support portion of the frame from the target portion of the frame for adjustment of the angle of the frame after release (FIG. 4D).

In embodiments, an angle adjustment wheel 18*a* (as also shown in FIG. 3B), includes a wheel 19*a* with a radial aperture 21*a* that slidingly accepts a guide bolt 24*a* of the support portion therethrough. The wheel 19*a* includes lock pin apertures 20*a* adjacent to the radial aperture 21*a* that reversibly accept a lock pin 25*a* of the support portion therethrough to secure the angle 40 in place and prevent the target portion from moving relative to the support portion. The angle 40 is adjustable by transitioning the foot pedal 23*a* from an upright configuration (see FIG. 4C) to a downward configuration (see FIG. 4D), to remove the lock pin 25*a* from a lock pin aperture 20*a*, and pivotally moving the target portion (i.e., having left vertical member 15*a*) relative to the support portion (i.e., having left support member 10*a*) about a pivot point 22*a*. The angle 40 is securable in place by returning the foot pedal to the upright position which returns the lock pin 25*a* into the lock pin aperture 20*a*, i.e., a different lock pin aperture 20*a* than was utilized before the adjustment. Since the lock pin 25*a* is hingedly attached to the foot pedal 23*a* via a hinge connection 26*a*, the pivotal movement of the foot pedal results in a lateral movement of the lock pin 25*a*. In this manner, the foot pedal 23*a* may be easily used by stepping thereon with a foot or shoe 27. During the adjustment the guide bolt 24*a* moves slidingly through the radial aperture 21*a* to minimize irregular or out-of-plane movements of the target portion relative to the support portion, and in this manner, the angle adjustment wheel 18*a* is rugged and withstands significant forces during handling, use, and adjustment to prolong the useful life of the system 3.

While certain views and their associated descriptions are provided herein only for left-side features, such as the angle adjustment wheel 18*a* of FIG. 3B, the same or substantially similar structural features and modes of operation are expressly envisioned and included for the right-side features, such as the angle adjustment wheel 18*b* of FIG. 3A, even if such right-side structures and modes may be considered to be mirrored or opposite relative to those which are expressly shown and described for the left-side features.

c. Net Attachment Tools

Figure 3C:
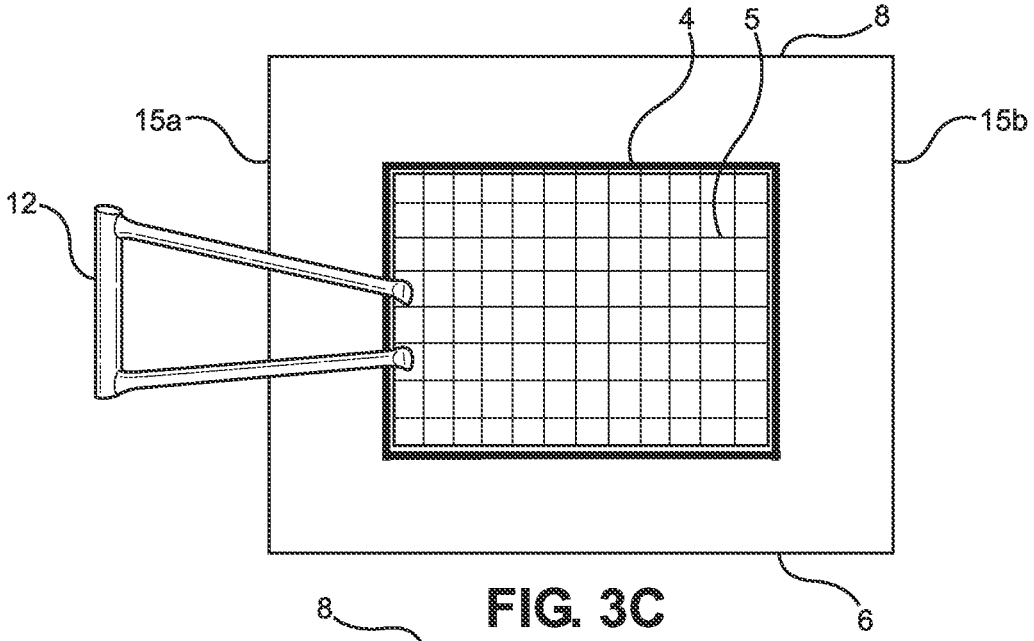
FIG. 3C shows a high-level conceptual schematic of use of an example net attachment tool to attach a net to a frame before attachment.
Figure 3D:
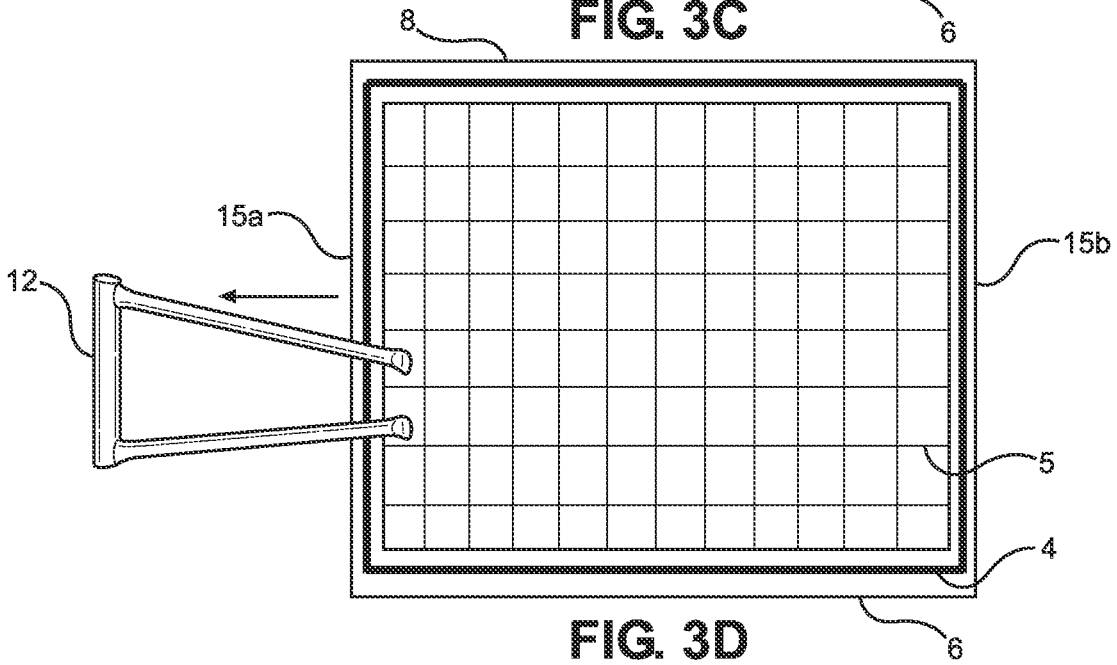
FIG. 3D shows a high-level conceptual schematic of use of the net attachment tool to attach the net to the frame after attachment.
Figure 3E:
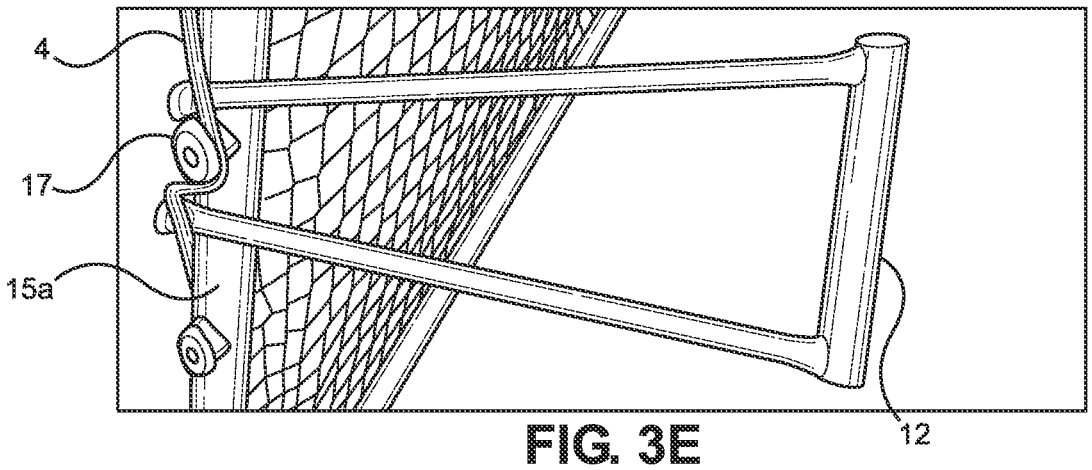
FIG. 3E shows a perspective view of use of the net attachment tool to attach the net to the frame.

Referring now to FIGS. 3C, 3D, and 3E, there are shown a high-level conceptual schematic of use of an example net attachment tool to attach a net to a frame before attachment (FIG. 3C), a high-level conceptual schematic of use of the net attachment tool to attach the net to the frame after attachment (FIG. 3D), and a perspective view of use of the net attachment tool to attach the net to the frame (FIG. 3E). The net attachment tool may be a component of the system or a kit as shown at FIG. 2A.

In embodiments, the ball rebounder system comprises a net attachment tool 12 configured to secure the net 4 to the target portion (6, 8, 15*a*, 15*b*) to form the goal, however, in another aspect, the net attachment tool 12 may be provided, made, or used alone without other components of the ball rebounder system or kit. In certain embodiments, the net attachment tool 12 may be used for any elastic training equipment as needed, including but not limited to ball rebounder systems and trampolines. The net attachment tool 12 may include a handle portion 12*a* and a hook portion 12*c*, such that the hook portion 12*c* is configured to hook a portion of the net 5 and/or the elastic cord 4 to pull the net 5 and/or elastic cord 4 over the net hooks and/or elastic cord attachments of the target portion. In embodiments, the hook portion 12*c* includes two hook portion members. The net attachment tool generally provides increased leverage to the individual during use.

To attach the net 5 to the target portion, the net attachment tool 12 may be gripped by an individual, used to hook the elastic cord 4 of the net 5, and used to pull the elastic cord 4 of the net 5 around the vertical members 15*a* and 15*b* and crossbars 6 and 8 of the frame and around the grooves of the elastic cord attachments 17 and, if present in an embodiment, the net hooks. The net attachment tool 12 provides increased leverage for hooking and pulling the elastic cord 4 around the elastic cord attachments 17 and/or net hooks and for securing it within the grooves of the attachments 17 and/or net hooks. Specifically, a fulcrum of the net attachment tool 12 may be slidably adjustable or defined during attachment. In this manner, the net attachment tool 12 may be used to secure the net 5 and/or the elastic cord 4 more easily and at a higher tensile level compared to manual securement alone. While the net attachment tool 12 is shown as being used for the ball rebounder system, it may be used for other elastic training equipment, including but not limited to trampolines.

II. Kits

In embodiments, the disclosure provides a variety of kits that include a ball rebounder system as disclosed herein. The kits may be provided or sold via e-commerce, by mail, and/or in person. In embodiments, the kits may further include instructional materials for assembling, configuring, adjusting, repairing, maintaining, and/or disassembling the system included with the kit. The improved elastic training equipment disclosed herein, including improved ball rebounders and improved trampolines that are more easily assembled and that are more configurable for a variety of different athletic activities, may be manufactured by any suitable method, whether known or unknown or to be developed or adopted in the future.

III. Methods

Figure 6:
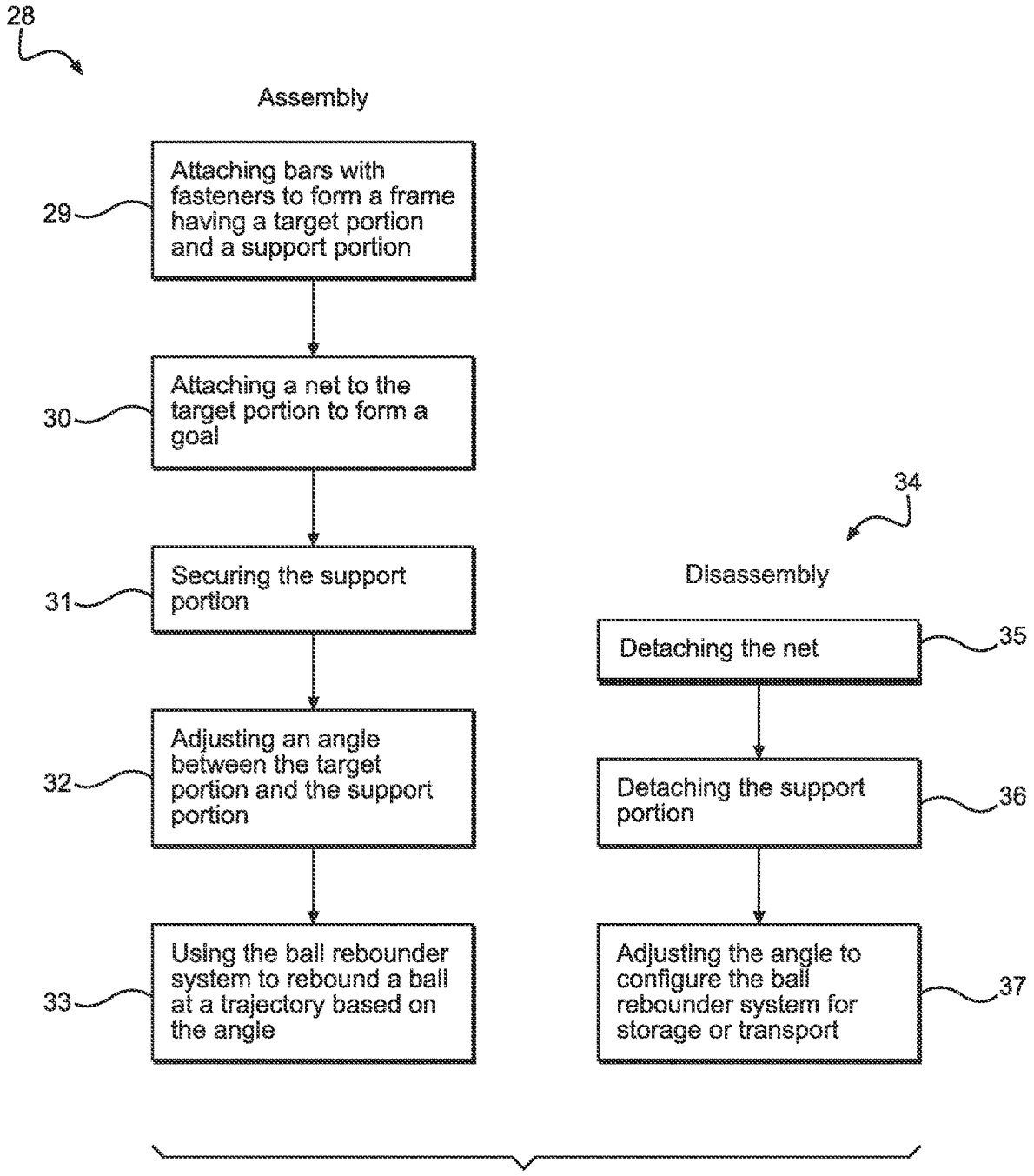
FIG. 6 shows a flow chart of methods of assembly and disassembly of an example rebounder system.

Referring now to FIG. 6, there is shown a flow chart of methods of assembly and disassembly of an example rebounder system. A method of assembly 28 may comprise attaching 29 bars with fasteners to form a frame having a target portion and a support portion, attaching 30 a net to the target portion to form a goal, securing 31 the support portion, and adjusting 32 an angle between the target portion and the support portion. Methods of use may then involve using 33 the ball rebounder system to rebound a ball at a trajectory based on the angle. A method of disassembly 34 may comprise detaching 35 the net from the target portion, detaching 36 the support portion from the target portion, and adjusting 37 the angle to configure the ball rebounder system for storage and/or transport, i.e., such that the angle is minimal, and the support portion is at least about parallel or coplanar with the target portion. In various embodiments, the net may be attached to the target portion using a net attachment tool, as disclosed herein, and/or the angle may be adjusted by operating a foot pedal and pivotally moving the target portion relative to the support portion about a pivot point, as disclosed herein.

Figure 7A:
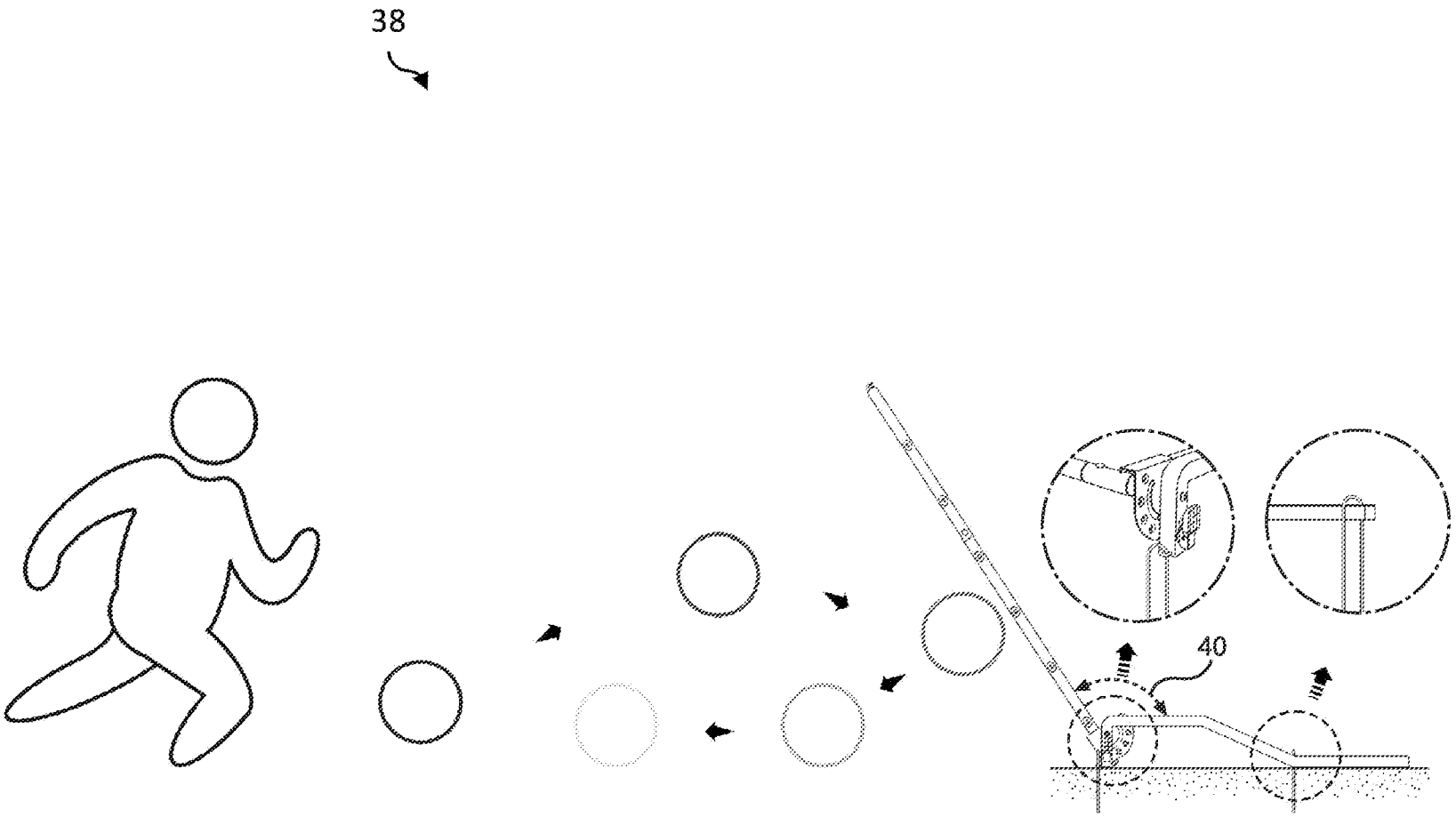
FIG. 7A shows use of the example soccer rebounder system with the frame angle at an increased position.
Figure 7B:
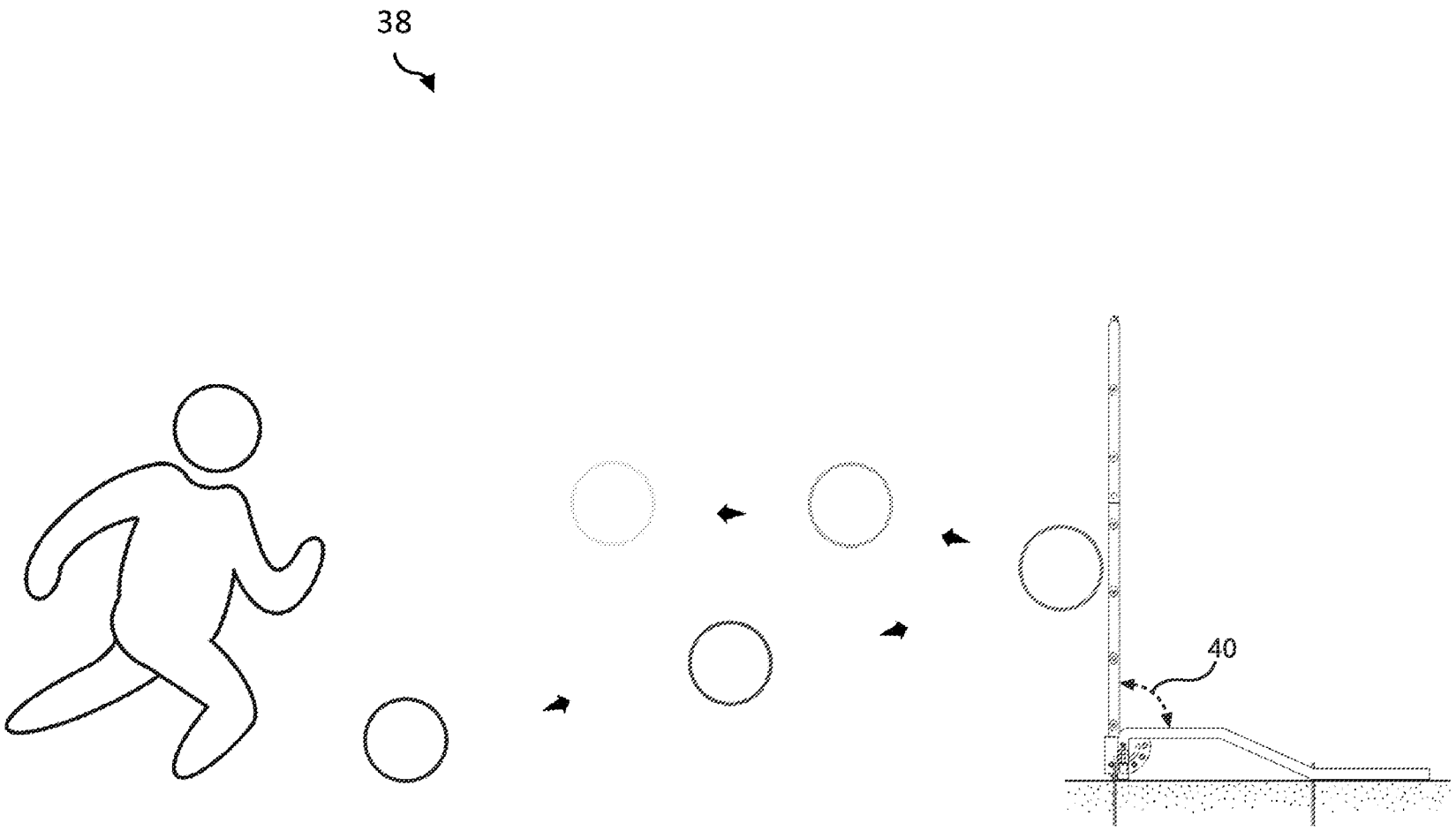
FIG. 7B shows use of the example soccer rebounder system with the frame angle at an intermediate position.
Figure 7C:
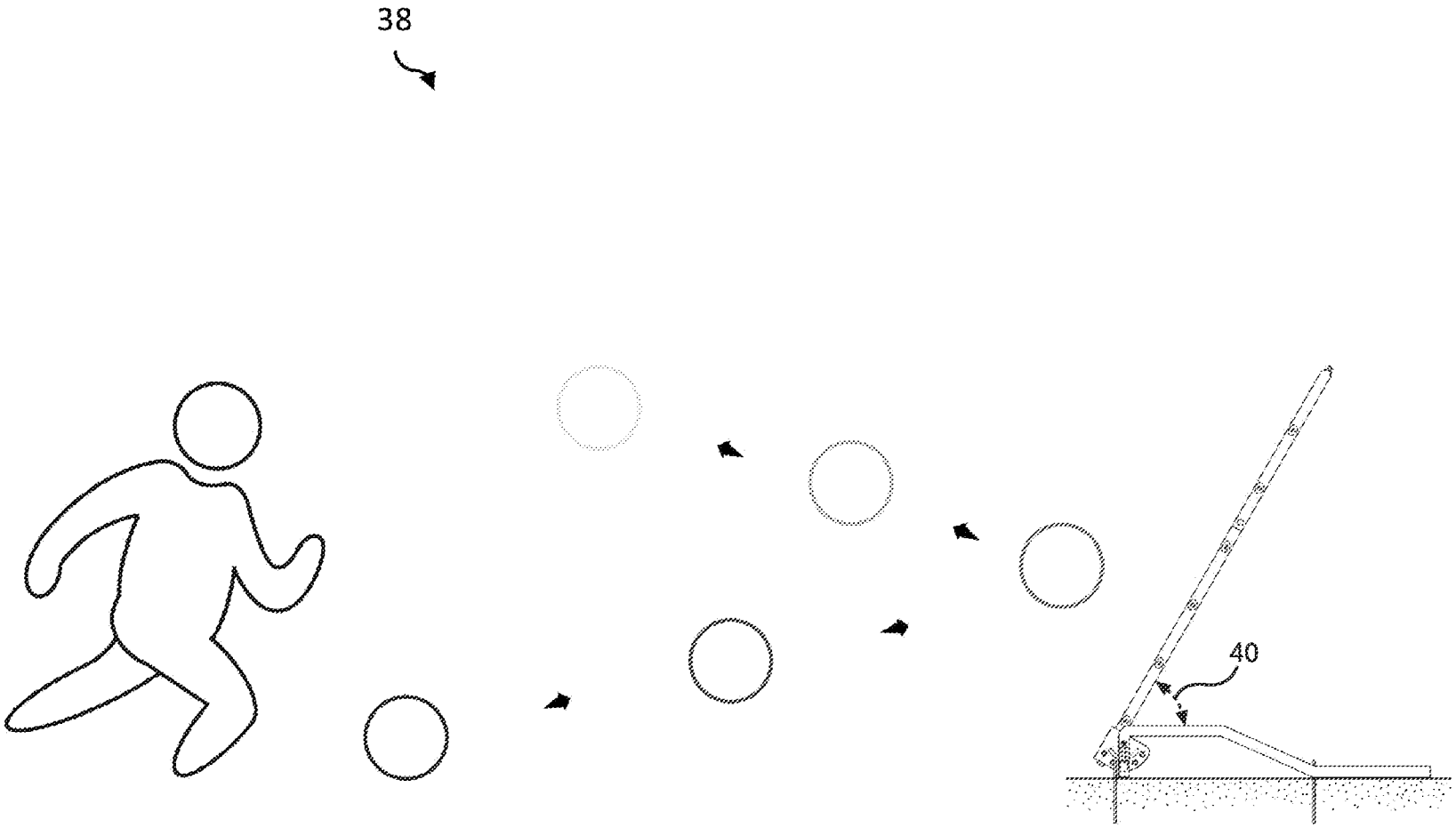
FIG. 7C shows use of the example soccer rebounder system with the frame angle at a first decreased position.
Figure 7D:
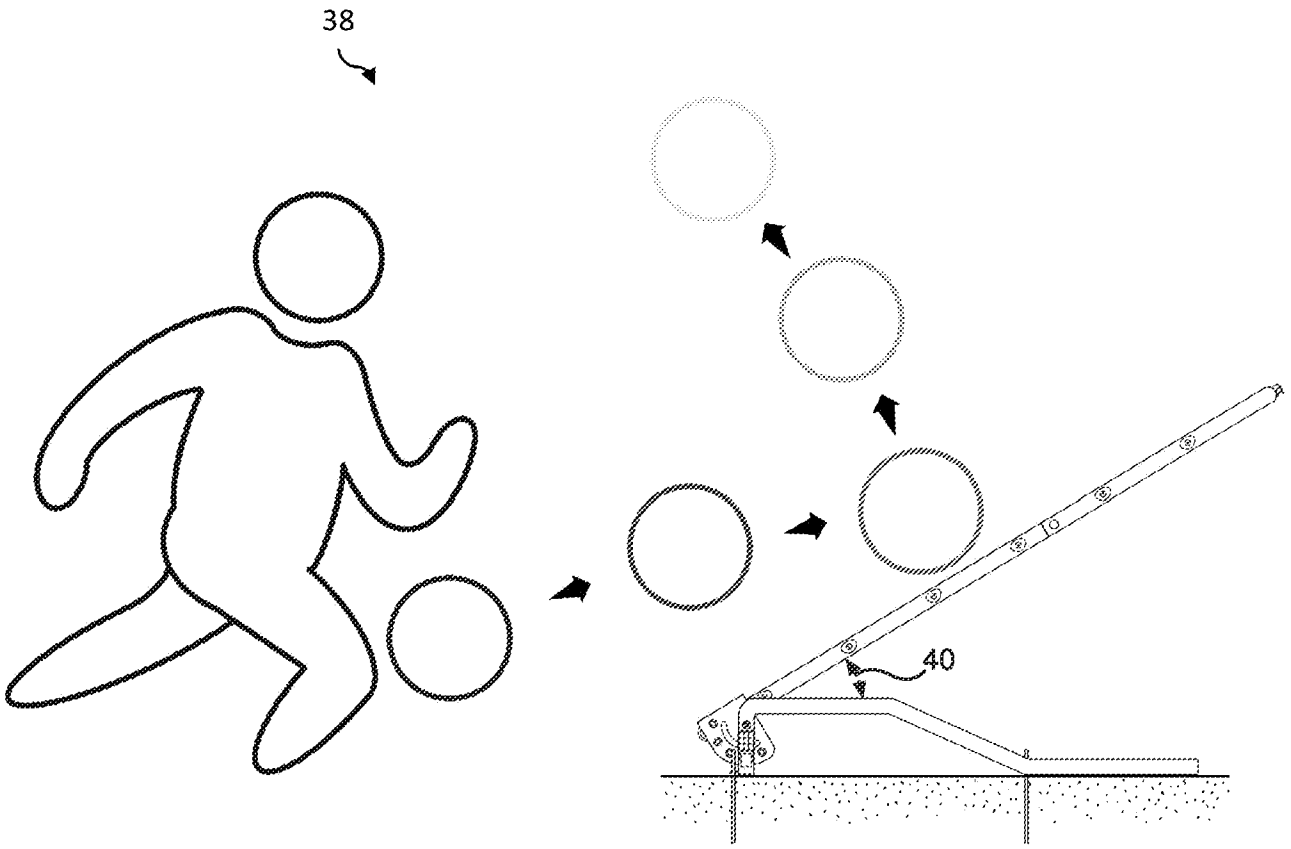
FIG. 7D shows use of the example soccer rebounder system with the frame angle at a second decreased position.
Figure 7E:
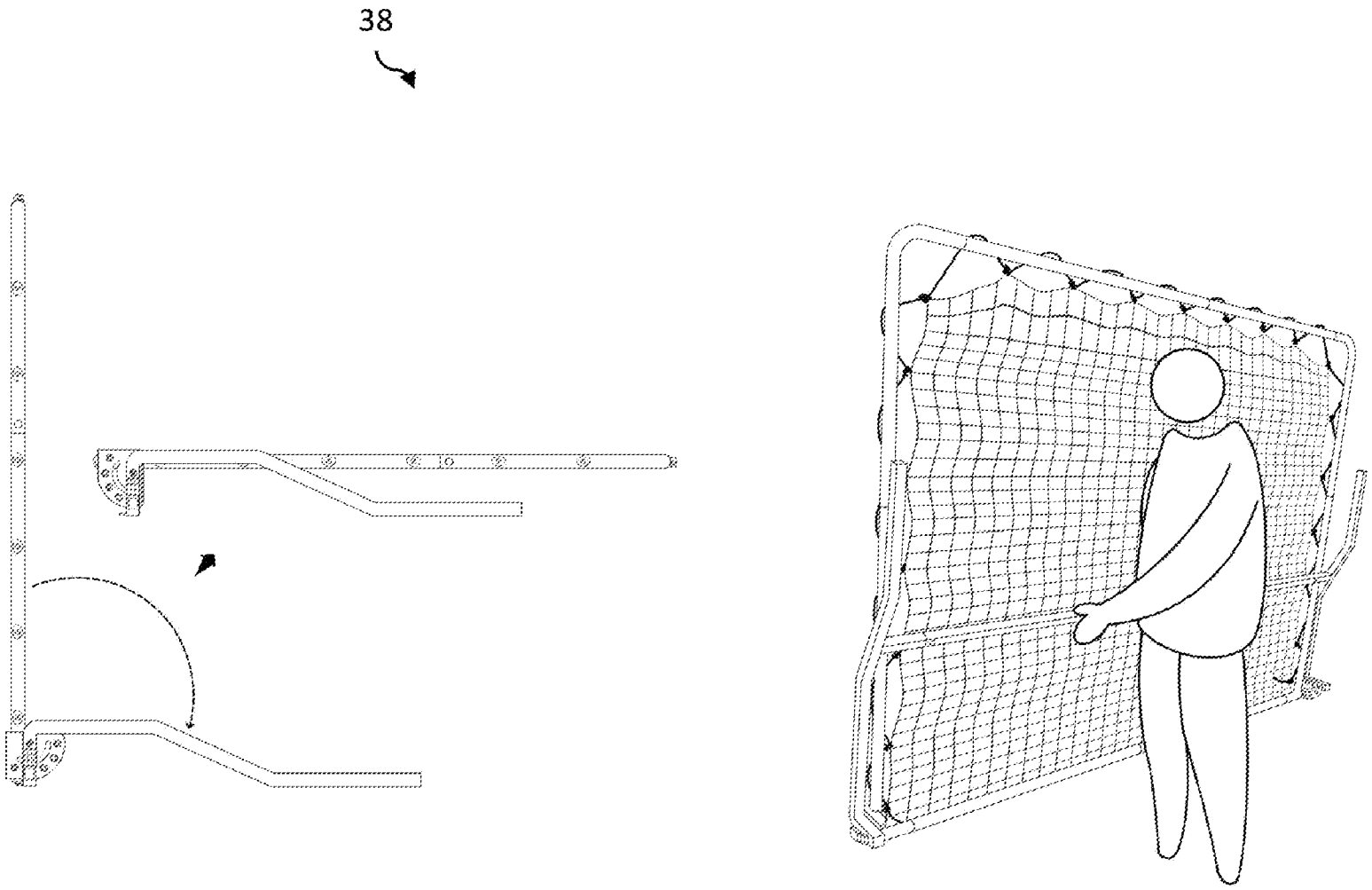
FIG. 7E shows configuration of the example soccer rebounder system for storage and transport with the frame angle at a minimized position.

Referring now to FIGS. 7A-7E, there are shown example uses of the example soccer rebounder system with the frame angle 40 at an increased position (FIG. 7A), with the frame angle 40 at an intermediate position (FIG. 7B), with the frame angle 40 at a first decreased position (FIG. 7C), with the frame angle 40 at a second decreased position (FIG. 7D), and storage and transport with the frame angle 40 at a minimized position (FIG. 7E). Once assembled, an individual may use 38 the ball rebounder system to rebound a ball at a trajectory based on the angle 40. To disassemble the ball rebounder system, the disassembly method may be performed, the disassembly method comprising detaching the net from the target portion, detaching the support portion from the target portion, and/or adjusting the angle 40 to configure the ball rebounder system for storage or transport as shown at FIG. 7E.

The goal may be used to rebound an object, including but not limited to a ball (e.g., a soccer ball, a baseball, a softball, a volleyball, a basketball, a lacrosse ball, etc.) or alternatively, an athlete (e.g., a gymnast) that impacts the goal. The rebounder system may be a ball rebounder, a trampoline, or both, or may be a different rebounder system, without departing from the scope of the disclosure. Accordingly, the disclosure broadly provides improved systems and methods for more easily and effectively making and using rebounder systems for rebounding balls, athletes, or other objects.

The foregoing descriptions of specific implementations have been presented for purposes of illustration and description. They are not intended to be exhaustive or to limit the invention to the precise forms disclosed, and modifications and variations are possible in view of the above teaching. The example implementations were chosen and described to best explain the principles of the invention and its practical application, to thereby enable others skilled in the art to best utilize the invention and its implementations with modifications as suited to the use contemplated.

It is therefore submitted that the invention has been shown and described in the most practical implementations. It should be recognized that departures may be made which fall within the scope of the invention. With respect to the description provided herein, it is submitted that the optimal features of the invention include variations in size, materials, shape, form, function, manner of operation, assembly, and use. All structures, functions, and relationships equivalent or essentially equivalent to those disclosed are intended to be encompassed by the invention.

Any discussion of documents or subject matter included in the present disclosure is not to be taken as an admission that any or all of these materials form part of the prior art base or were common general knowledge in the field relevant to the present disclosure as it existed before the priority date of each claim of this and any continuing application.

I claim:

1. A rebounder system, comprising:

a net;

a frame having a target portion and a support portion, wherein the net is securable to the target portion to form a goal and an angle between the target portion and the support portion is adjustable;

a locking element transferable between an unlocked configuration and a locked configuration, wherein in the unlocked configuration the angle can be increased or decreased by a pivot movement of the target portion relative to the support portion about a pivot point and in the locked configuration the angle is fixed; and a foot pedal operable to transfer the locking element between the unlocked configuration and the locked configuration, wherein the goal is configured to rebound an object at a trajectory based on the angle, wherein the locking element includes a locking pin coupled to the foot pedal and a plurality of recesses configured to receive the locking pin, wherein the locking pin is positioned in one of the recesses when the locking element is in the locked configuration and is disengaged from the recess when the locking element is in the unlocked configuration, and wherein the foot pedal is movable between a first position and a second position and the foot pedal moves the locking pin out of the recess as the foot pedal moves from the first position to the second position.

2. The system of claim 1, wherein the net is securable to the target portion by attachment of an elastic cord to a plurality of elastic attachments of the target portion.

3. The system of claim 1, wherein the target portion includes an angle adjustment wheel affixed thereto having a radial aperture that slidingly accepts a guide bolt of the support portion therethrough;

wherein the angle adjustment wheel includes lock pin apertures adjacent to the radial aperture that reversibly accept a lock pin of the support portion therethrough to secure the angle.

4. The system of claim 1, further comprising a plurality of stakes configured to secure the frame to a ground thereunder.

5. The system of claim 1, further comprising a net attachment tool configured to increase leverage and facilitate securement of the net to the target portion to form the goal.

6. The system of claim 5, wherein the net attachment tool includes a handle portion and a hook portion that is configured to hook a portion of the net.

7. The system of claim 6, wherein the hook portion includes two hook portion members.

8. The system of claim 1, wherein the target portion includes a plurality of elastic cord attachments attached to an outer perimeter thereof.

9. The system of claim 8, wherein the target portion includes a plurality of net hooks attached to a lower crossbar of the outer perimeter thereof, wherein the net hooks secure the net in a forward position relative to the lower crossbar such that a ball contacts the net instead of the lower crossbar during use.

10. The system of claim 1, wherein the target portion is approximately rectangular and includes a left vertical member attached to a right vertical member by an upper crossbar and a lower crossbar.

11. The system of claim 10, wherein the support portion includes a left support member affixed to a right support member by a support crossbar.

12. The system of claim 11, wherein the left support member and the right support member extend rearward and downward from the target portion.

13. The system of claim 1, wherein the frame is comprised of a plurality of bars that are attachable with a plurality of fasteners.

14. The system of claim 13, wherein the target portion is comprised of a plurality of target portion bars and the support portion is comprised of a plurality of support portion bars.

15. The system of claim 1, wherein the target portion includes a top target member and a bottom target member, and wherein the system includes a net having a top net portion coupled to the top target member and a bottom net portion with a bottom edge coupled to the bottom target member such that the bottom edge is below an upper edge of the bottom target member.

16. The system of claim 1, further comprising a guide at least partially positioned within a track, the guide relative to the track as the target portion is moved relative to the support portion.

17. A rebounder system, comprising:

a net having an elastic cord forming a perimeter thereof;

a frame having a target portion and a plurality of anchors fixed to the frame; and a net attachment tool engageable with the frame, the net attachment tool comprising:

a handle;

a first hook portion extending from the handle; and a second hook portion extending from the handle, the second hook portion spaced from the first hook portion such that the first and second hook portions straddle a first one of the plurality of anchors when first and second hook portions are engaged with the elastic cord and the elastic cord is engaged with a second one of the plurality of anchors, wherein the net attachment tool is configured to engage the frame, thereby increasing leverage on the elastic cord from the first and second hook portions when a force is applied to the handle to secure the elastic cord to the first one of the plurality of anchors to form a goal;

wherein the goal is configured to rebound an object that impacts the goal.

18. A method for assembling a rebounder system, the method comprising:

attaching a plurality of bars with a plurality of fasteners to form a frame having a target portion and a support portion, wherein an angle between the target portion and the support portion is adjustable, the target portion including a bottom member, a top member, at least one side member, and a plurality of net hooks coupled to the bottom member; and attaching a net to the target portion to form a goal that is configured to rebound an object at a trajectory based on the angle, the net including an elastic cord along a top and sides of the net, wherein the attaching step includes coupling a bottom portion of the net to the plurality of net hooks such that the bottom portion of the net is spaced in front of the bottom member such that a ball directed at the net contacts the net instead of the bottom member and coupling the elastic cord to the top and at least one side member.

19. The method of claim 18, wherein the rebounder system includes a locking element transferable between an unlocked configuration and a locked configuration, wherein in the unlocked configuration the angle can be increased or decreased by a pivot movement of the target portion relative to the support portion about a pivot point and in the locked configuration the angle is fixed and the method further comprises:

moving a foot pedal from a first position to a second position, thereby transferring the locking element from the locked configuration to the unlocked configuration;

moving the target portion relative to the support portion so as to adjust the angle while the foot pedal is in the second position; and moving the foot pedal from the second position to the first position, thereby transferring the locking element from the unlocked configuration to the locked configuration.

20. The system of claim 17, further comprising:

a frame having a target portion and a support portion, wherein the net is securable to the target portion to form a goal and an angle between the target portion and the support portion is adjustable;

a locking element transferable between an unlocked configuration and a locked configuration, wherein in the unlocked configuration the angle can be increased or decreased by a pivot movement of the target portion relative to the support portion about a pivot point and in the locked configuration the angle is fixed; and a foot pedal operable to transfer the locking element between the unlocked configuration and the locked configuration.

* * * * *